US008622151B2

(12) United States Patent
Ledbetter

(10) Patent No.: US 8,622,151 B2
(45) Date of Patent: Jan. 7, 2014

(54) FEED CABLE SYSTEM FOR A TOWER OF A DRILLING MACHINE

(75) Inventor: Timothy W. Ledbetter, Sachse, TX (US)

(73) Assignee: Atlas Copco Drilling Solutions LLC, Garland, TX (US)

( * ) Notice: Subject to any disclaimer, the term of this patent is extended or adjusted under 35 U.S.C. 154(b) by 241 days.

(21) Appl. No.: 13/129,762

(22) PCT Filed: Sep. 21, 2009

(86) PCT No.: PCT/US2009/057736

§ 371 (c)(1),
(2), (4) Date: May 17, 2011

(87) PCT Pub. No.: WO2010/033947

PCT Pub. Date: Mar. 25, 2010

(65) Prior Publication Data

US 2011/0266064 A1 Nov. 3, 2011

Related U.S. Application Data

(60) Provisional application No. 61/098,783, filed on Sep. 21, 2008.

(51) Int. Cl.
*E21B 31/06* (2006.01)

(52) U.S. Cl.
USPC ..... 175/52; 175/85; 175/195

(58) Field of Classification Search
USPC ..... 175/52, 85, 162, 195, 203
See application file for complete search history.

(56) References Cited

U.S. PATENT DOCUMENTS

| | | | | |
|---|---|---|---|---|
| 3,245,180 | A | | 4/1966 | Bules et al. |
| 3,692,123 | A | | 9/1972 | Gyongyosi |
| 3,708,024 | A | | 1/1973 | Back |
| 3,778,940 | A | | 12/1973 | Blecken |
| 3,815,690 | A | | 6/1974 | Cooper |
| 3,833,072 | A | | 9/1974 | Back |
| 3,854,537 | A | * | 12/1974 | Nelmark et al. ..... 173/140 |
| 3,905,168 | A | | 9/1975 | Nelmark et al. |
| 3,968,845 | A | | 7/1976 | Chaffin |
| 3,992,831 | A | | 11/1976 | Bukovitz et al. |
| 4,020,909 | A | | 5/1977 | Airaudo |
| 4,170,340 | A | | 10/1979 | Mouton, Jr. |

(Continued)

FOREIGN PATENT DOCUMENTS

WO 97/24507 A1 7/1997

OTHER PUBLICATIONS

PCT/US2009/057736 International Search Report and Written Opinion dated Apr. 6, 2011.

*Primary Examiner* — William P Neuder
(74) *Attorney, Agent, or Firm* — Schmeiser, Olsen & Watts LLP

(57) ABSTRACT

A drilling machine includes a feed cable system which operatively couples a rotary head to a tower. The feed cable system includes first and second pull up cables and an equalizer bar, wherein the equalizer bar is coupled to the first and second pull up cables. The equalizer bar drives the rotary head to be held in a level position so that it is restricted from tilting. The drilling machine includes a slack take up device which couples the equalizer bar to the tower. The slack take up device is repeatably moveable between extended and retracted conditions.

24 Claims, 14 Drawing Sheets

(56) References Cited

U.S. PATENT DOCUMENTS

| | | | | |
|---|---|---|---|---|
| 4,295,758 | A | | 10/1981 | Yashima |
| 4,478,291 | A | | 10/1984 | Futros |
| 4,595,065 | A | | 6/1986 | Wada et al. |
| 5,503,234 | A | * | 4/1996 | Clanton ..... 175/52 |
| 5,988,299 | A | | 11/1999 | Hansen et al. |
| 6,672,410 | B2 | | 1/2004 | Smith |
| 6,675,915 | B2 | | 1/2004 | Smith |
| 7,325,634 | B2 | | 2/2008 | Law et al. |
| 7,347,285 | B2 | | 3/2008 | Hamner |
| 7,413,036 | B2 | | 8/2008 | Law et al. |
| 2003/0056989 | A1 | | 3/2003 | Smith |
| 2003/0056993 | A1 | | 3/2003 | Smith |

* cited by examiner

Extended Condition

Retracted Condition

FEED CABLE SYSTEM FOR A TOWER OF A DRILLING MACHINE

CROSS-REFERENCE TO RELATED APPLICATIONS

This application claims priority to U.S. Provisional Application No. 61/098,783, filed on Sep. 21, 2008 by the same inventors, the contents of which are incorporated by reference as though fully set forth herein.

BACKGROUND OF THE INVENTION

1. Field of the Invention

This invention relates generally to feed cable systems for drilling machines.

2. Description of the Related Art

There are many different types of drilling machines for drilling through a formation. Some of these drilling machines are mobile and others are stationary. Some examples of mobile and stationary drilling machines are disclosed in U.S. Pat. Nos. 3,245,180, 3,692,123, 3,708,024, 3,778,940, 3,815,690, 3,833,072, 3,905,168, 3,968,845, 3,992,831, 4,020,909, 4,170,340, 4,478,291, 4,595,065, 5,988,299, 6,672,410, 6,675,915, 7,325,634, 7,347,285 and 7,413,036, as well as U.S. Patent Application No. 2003056989 and International Application No. PCT/NO96/00310. Some drilling machines, such as the one disclosed in U.S. Pat. No. 4,295,758, are designed to float and are useful for ocean drilling. The contents of these cited U.S. Patents are incorporated by reference as though fully set forth herein.

A typical mobile drilling machine includes a vehicle and tower, wherein the tower carries a rotary head and drill string. The rotary head is coupled with the tower using a feed cable system, wherein the feed cable system allows the rotary head to move between raised and lowered positions. In operation, the drill string is driven into the formation by the rotary head. In this way, the drilling machine drills through the formation. More information about drilling machines, and how they operate, can be found in the above-identified references.

The feed cable system typically includes two pull up cables which couple the rotary head to the top of the tower. The two pull up cables are separately coupled to the tower, as disclosed in U.S. Pat. No. 7,413,036 and U.S. Patent Application No. 20030056993, so that the tension in the pull up cables can be different. It is desirable, however, to have the tension in the two pull up cables to be the same so that the rotary head is held level. When the tension in the two pull up cables are different, the rotary head tilts so that it is not held level.

BRIEF SUMMARY OF THE INVENTION

The present invention provides a drilling machine with a feed cable system. The novel features of the invention are set forth with particularity in the appended claims. The invention will be best understood from the following description when read in conjunction with the accompanying drawings.

DETAILED DESCRIPTION OF THE INVENTION

Figure 1:
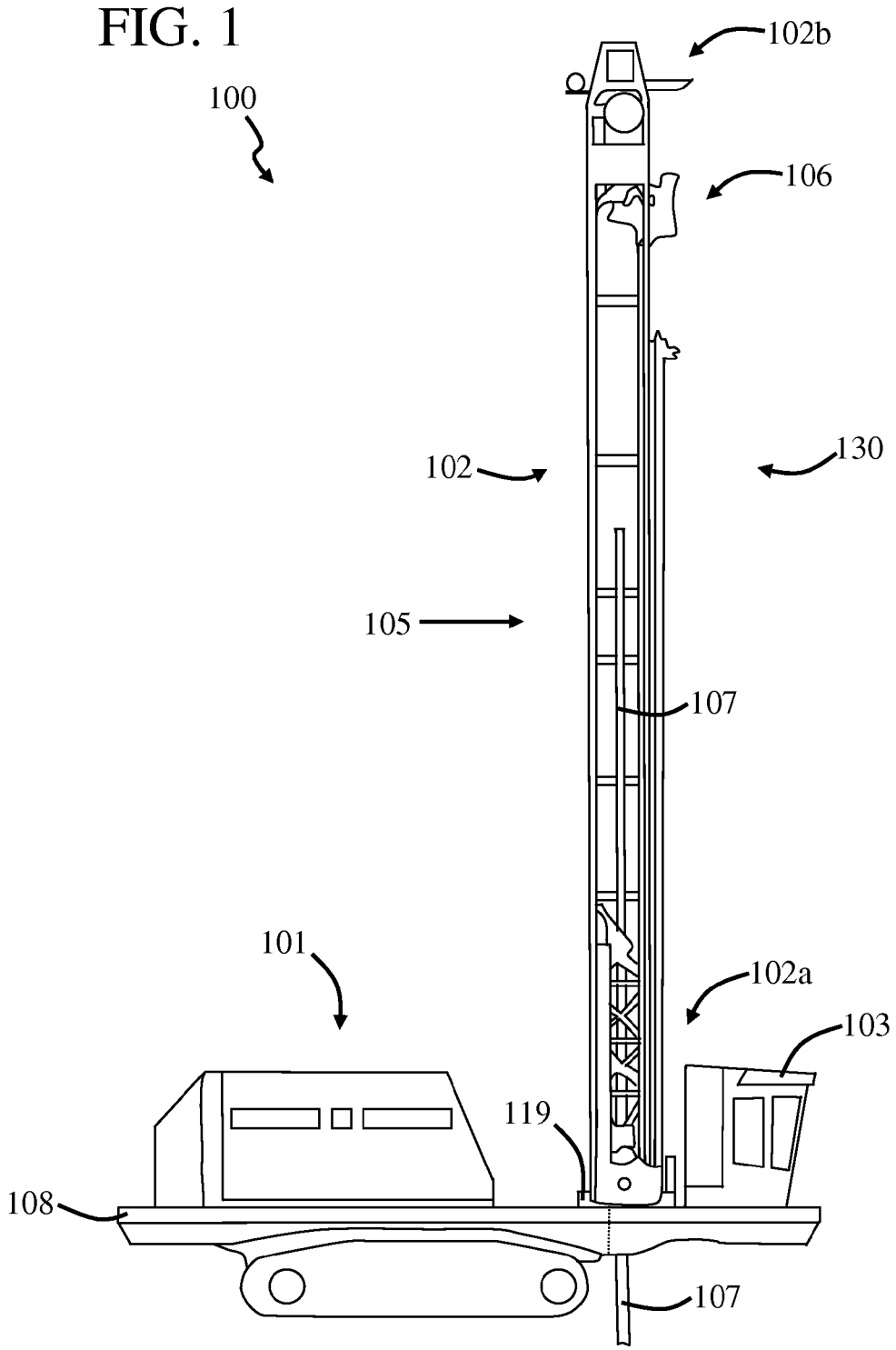
FIG. 1 is a side view of a drilling machine which includes a tower carried by a platform, wherein the tower includes a feed cable system.

FIG. 1 is a side view of a drilling machine 100. It should be noted that drilling machine 100 can be stationary or mobile, but here it is embodied as being mobile for illustrative purposes. Some examples of different types of drilling machines are the PV-235, PV-270, PV-271, PV-275 and PV-351 drilling machines, which are manufactured by Atlas Copco Drilling Solutions of Garland, Tex. It should be noted, however, that drilling machines are provided by many other manufacturers.

In this embodiment, drilling machine 100 includes a platform 108 which carries a power pack 101 and operator's cab 103. Power pack 101 typically includes many different components, such as a prime mover. Operator's cab 103 includes controls for controlling the operation of drilling machine 100.

In this embodiment, drilling machine 100 includes a tower 102 which is carried by a table 119, wherein table 119 is coupled to platform 108. Tower 102 includes a tower base 102*a* and tower crown 102*b*, wherein tower base 102*a* is positioned proximate to table 119 and tower crown 102*b* is positioned away from table 119. Tower 102 is rotatably mounted to platform 108 so that it is repeatably moveable between raised and lowered positions.

In this embodiment, tower 102 carries a feed cable system 130 and rotary head 106. Feed cable system 130 will be discussed in more detail below. Rotary head 106 is operatively coupled with a drill string 107. Drill string 107 generally includes one or more drill pipes connected together in a well-known manner. The drill pipes of drill string 107 are capable of being attached to an earth bit (not shown), such as a tri-cone rotary earth bit. Rotary head 107 is moved between the raised and lowered positions to raise and lower, respectively, drill string 107 through table 119 and tower 102. Rotary head 107 is moved between the raised and lowered positions to raise and lower, respectively, the earth bit through a formation. Further, rotary head 106 is used to rotate drill string 108 so that the earth bit is rotated through the formation. It should be noted that the operation of rotary head 106 and feed cable system 130 is typically controlled by the operator in operator's cab 103.

Figure 2A:
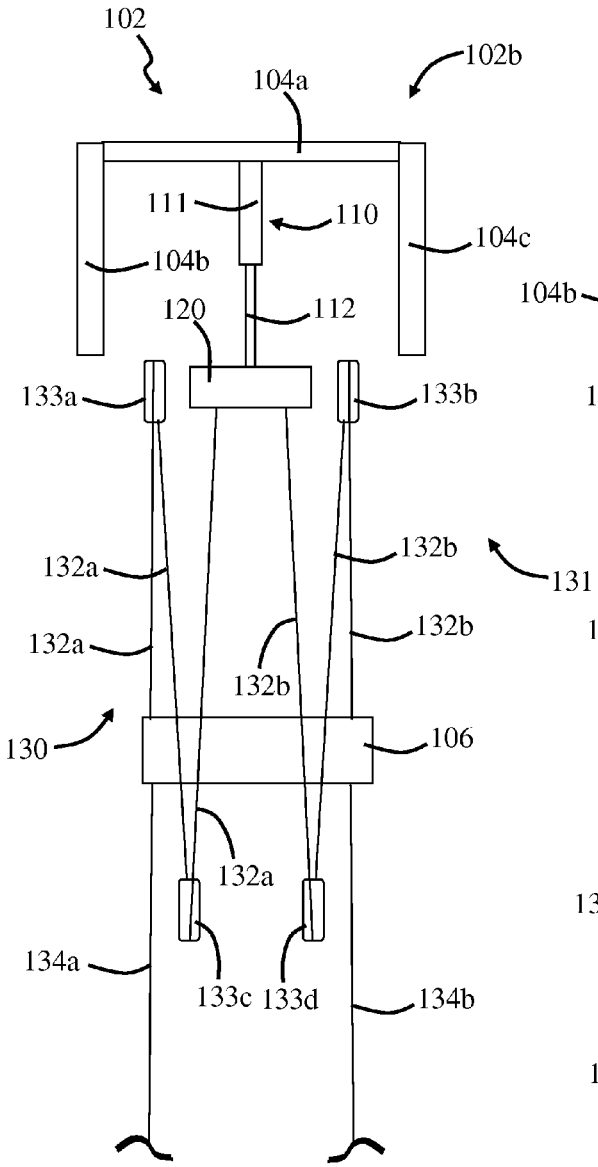
FIGS. 2*a* and 2*b* are side views of a tower crown of the tower of FIG. 1 with a rotary head in raised and lowered positions, respectively, wherein the rotary head is carried by the feed cable system.
Figure 2B:
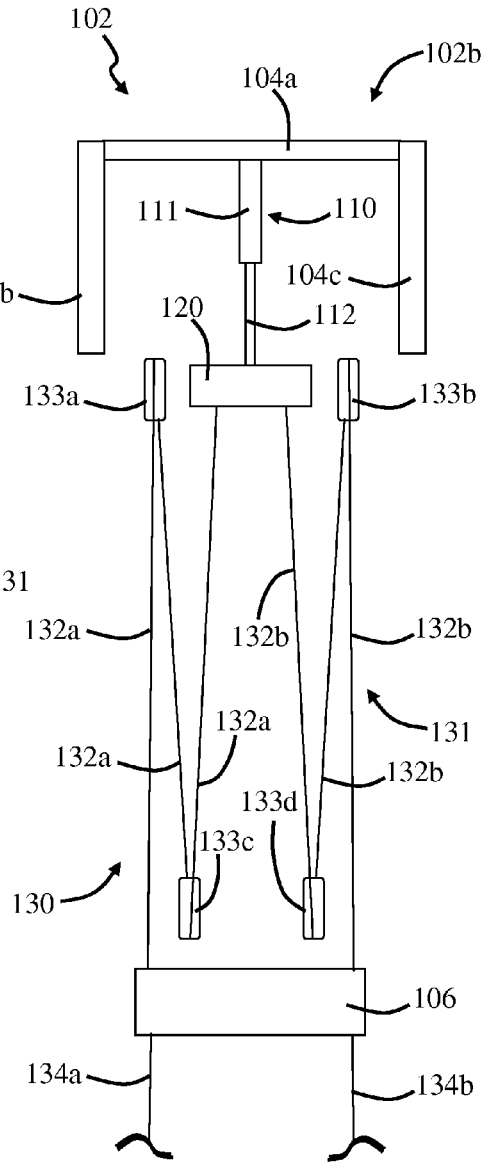
Figure 2C:
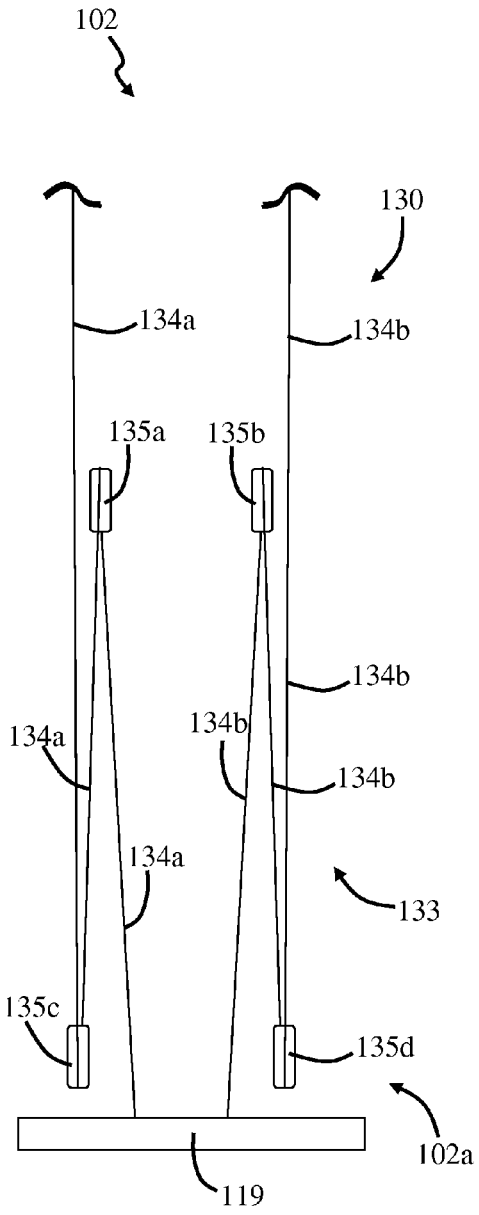
FIGS. 2*c* and 2*d* are side views of a tower base of the tower of FIG. 1 with the rotary head in raised and lowered positions, respectively.
Figure 2D:
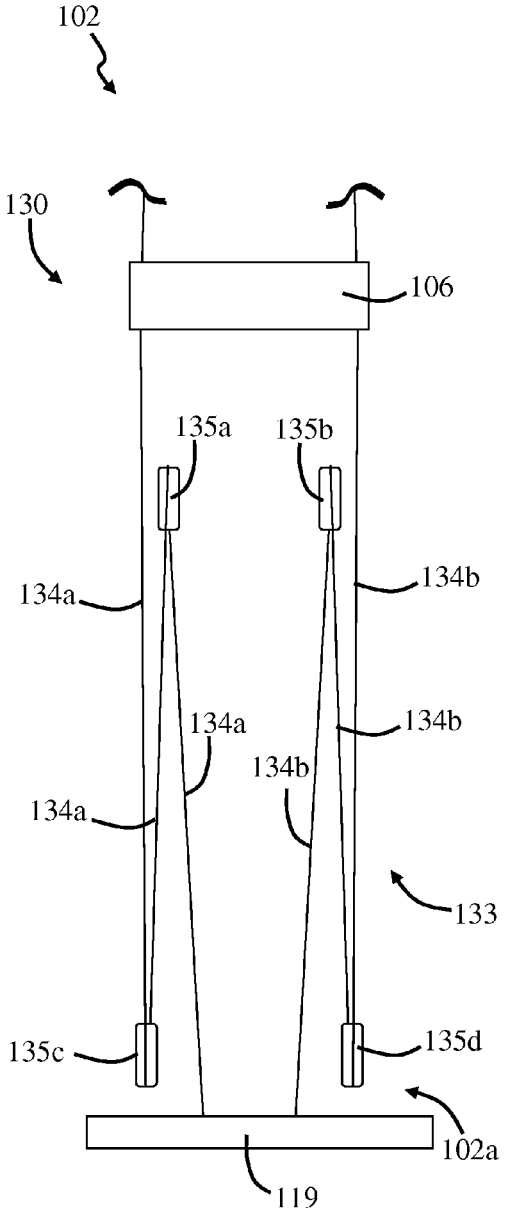
Figure 2E:
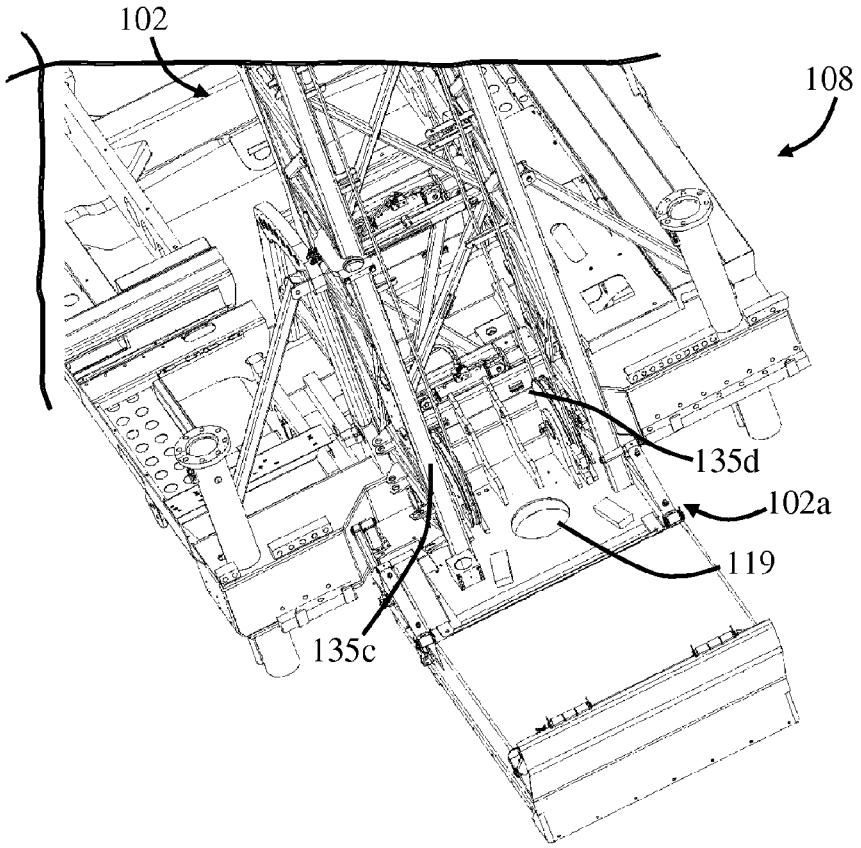
FIG. 2*e* is a perspective view of a tower base of the tower of FIG. 1 and a table.

FIGS. 2*a* and 2*b* are side views of tower crown 102*b* with rotary head 106 in raised and lowered positions, respectively, wherein rotary head 106 is carried by feed cable system 130. FIGS. 2*c* and 2*d* are side views of tower base 102*a* with rotary head 106 in raised and lowered positions, respectively. FIG. 2*e* is a perspective view of tower base 102*a* and table 119, wherein table 119 is rotatably coupled to platform 108. More information regarding the raising and lowering of rotary head with a feed cable system is provided in U.S. Patent Application No. 20030056993.

In this embodiment, feed cable system 130 includes pull up feed cable system 131 and pull down feed cable system 133. It should be noted that FIGS. 2*a* and 2*b* show pull up feed cable system 131 and FIGS. 2*c* and 2*d* show pull down feed cable system 133. Further, in this embodiment, tower crown 102*b* includes chord 104*a* and downwardly extending crowns 104*b* and 104*c* coupled thereto. As mentioned above, tower crown 102*b* is positioned away from table 119, so that chord 104*a* is positioned away from table 119. It should be noted that slack take up device can be coupled to tower 102 at other locations, such as a chord that is not included with tower crown 102*b*.

Feed cable system 130 includes a slack take up device 110 coupled to tower 102. Slack take up device 110 can be coupled to tower 102 in many different ways. In this embodiment, slack take up device 110 is coupled to chord 104*a*. Chord 104*a* is positioned away from table 119, so that slack take up device 110 is coupled to tower 102 away from table 119.

Slack take up device 110 operates as an actuator and is repeatably moveable between extended and retracted conditions. Slack take up device 110 can be embodied in many different ways. In this embodiment, slack take up device 110 includes a cylinder 111 and piston 112, wherein cylinder 111 is coupled with chord 104*a* and piston 112 is coupled with equalizer bar 120. In the extended condition, piston 112 is moved away from cylinder 111 and, in the retracted condition, piston 112 is moved towards cylinder 111. More information regarding slack take up device 110 is provided below.

In this embodiment, feed cable system 130 includes an equalizer bar 120 coupled with slack take up device 110. Hence, feed cable system 130 includes a slack take up device which couples an equalizer bar to a tower. In particular, feed cable system 30 includes a slack take up device which couples an equalizer bar to a chord of a tower crown.

In this embodiment, equalizer bar 120 is coupled with pull up cables 132*a* and 132*b*. In this way, feed cable system 130 includes a slack take up device which couples first and second pull up cables and to a tower crown through an equalizer bar. Pull up cable 132*a* extends between equalizer bar 120 and a pulley 133*c*, which is positioned below equalizer bar 120. Pull up cable 132*a* extends between pulley 133*c* and a pulley 133*a*, wherein pulley 133*a* is positioned above pulley 133*c*. Pull up cable 133*a* extends between pulley 133*a* and rotary head 106, wherein rotary head 106 is positioned below pulley 133*a*.

Pull up cable 132*b* extends between equalizer bar 120 and a pulley 133*d*, which is positioned below equalizer bar 120. Pull up cable 132*b* extends between pulley 133*d* and a pulley 133*b*, wherein pulley 133*b* is positioned above pulley 133*d*. Pull up cable 132*a* extends between pulley 133*b* and rotary head 106, wherein rotary head 106 is positioned below pulley 133*b*. It should be noted that, in this embodiment, pull up cables 132*a* and 132*b*, as well as pulleys 133*a*, 133*b*, 133*c* and 133*d* are included with pull up feed cable system 131. Further, in this embodiment, slack take up device 110 and equalizer bar 120 are also included with pull up feed cable system 131.

In this embodiment, feed cable system 130 includes pull down cables 134*a* and 134*b* with ends (not shown) coupled with table 119. Pull down cable 134*a* extends between table 119 and a pulley 135*a*, wherein pulley 135*a* is positioned above table 119. Pull down cable 134*a* extends between pulley 135*a* and a pulley 135*c*, wherein pulley 135*c* is positioned below pulley 135*a*. Pull down cable 134*a* extends between pulley 135*c* and rotary head 106, wherein rotary head 106 is positioned above pulley 135*c*.

Pull down cable 134*b* extends between table 119 and a pulley 135*b*, wherein pulley 135*b* is positioned above table 119. Pull down cable 134*b* extends between pulley 135*b* and a pulley 135*d*, wherein pulley 135*d* is positioned below pulley 135*b*. Pull down cable 134*b* extends between pulley 135*d* and rotary head 106, wherein rotary head 106 is positioned above pulley 135*d*. It should be noted that, in this embodiment, pull down cables 134*a* and 134*b*, as well as pulleys 135*a*, 135*b*, 135*c* and 135*d* are included with pull down feed cable system 133.

Figure 3B:
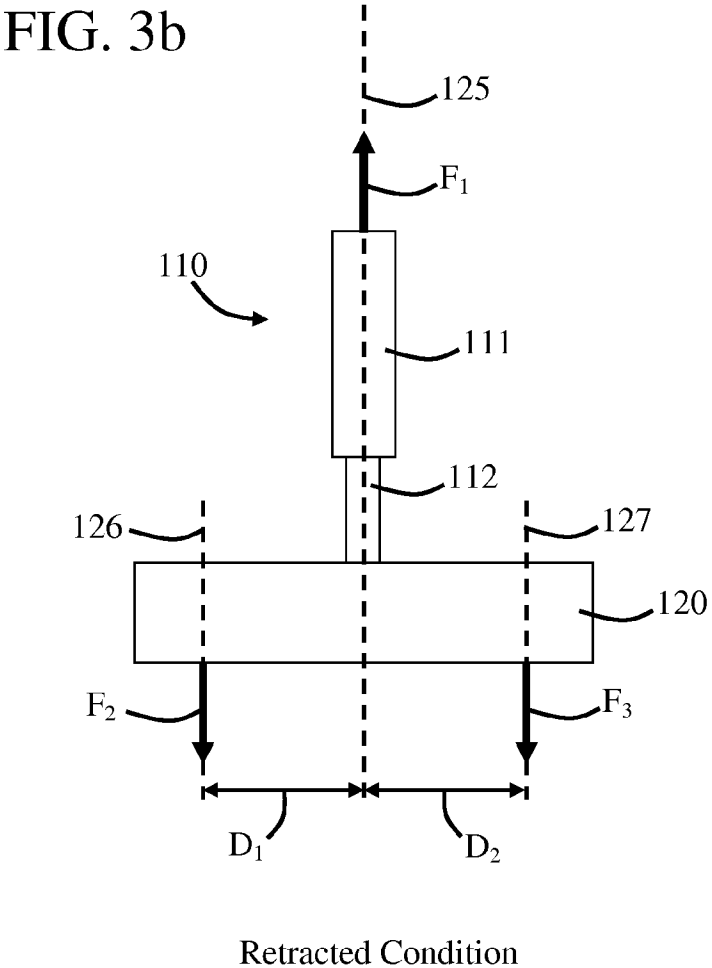
FIGS. 3*a* and 3*b* are is side views of a slack take up device coupled with an equalizer bar, wherein the slack take up device and equalizer bar are included with the feed cable system of FIGS. 2*a*, 2*b*, 2*c* and 2*d*.
Figure 3A:
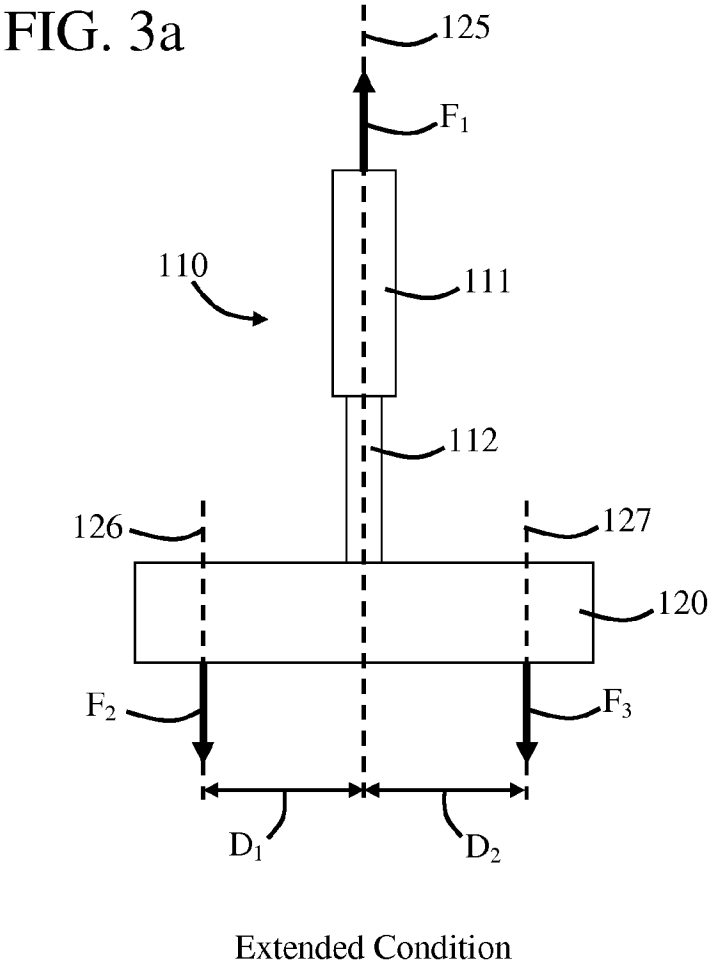
Figure 3C:
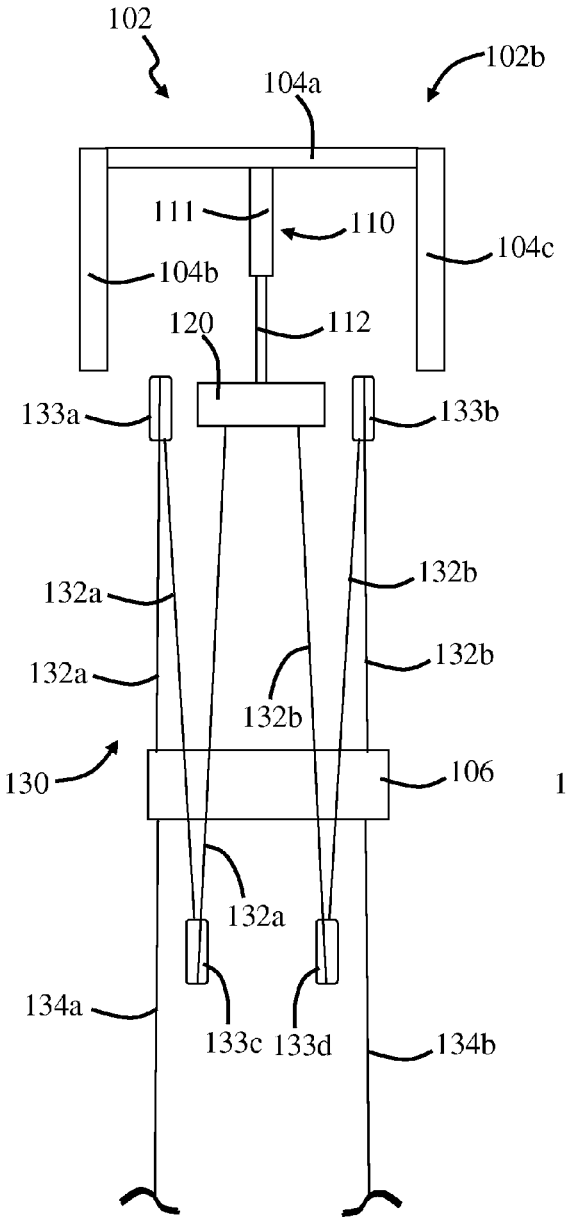
FIGS. 3*c* and 3*d* are side views of the tower crown of the tower of FIG. 1 with the rotary head in raised positions, and the slack take up device in extended and retracted conditions, respectively.
Figure 3D:
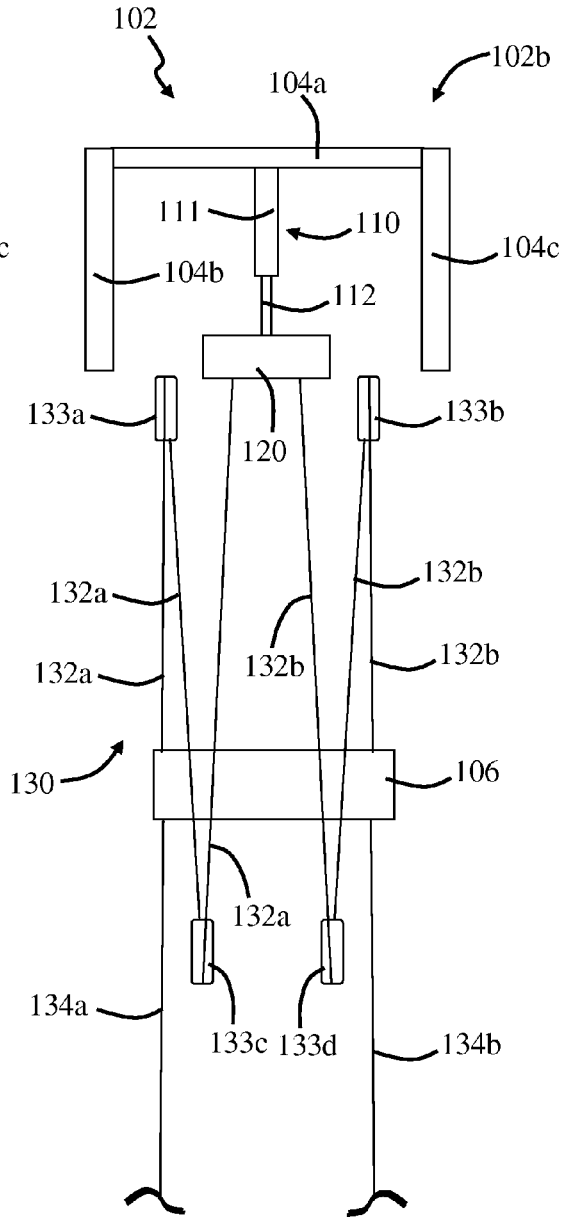

The operation of equalizer bar 120 and slack take up device 110 is discussed in more detail with reference to FIGS. 3*a*, 3*b*, 3*c* and 3*d*. FIGS. 3*a* and 3*b* are side views of slack take up device 110 coupled with equalizer bar 120. FIGS. 3*c* and 3*d* are side views of tower crown 102*b* of the tower 102 of FIG. 1 with rotary head 106 in the raised position, and slack take up device 110 in extended and retracted conditions, respectively.

As mentioned above, slack take up device 110 is repeatably moveable between extended and retracted conditions. Slack take up device 110 operates as an actuator and is repeatably moveable between extended and retracted conditions. In this embodiment, slack take up device 110 includes cylinder 111 and piston 112. In the extended condition of FIG. 3*a*, piston 112 is moved away from cylinder 111 and, in the retracted condition of FIG. 3*b*, piston 112 is moved towards cylinder 111. In the extended condition, equalizer bar 120 moves away from chord 104*a* (FIGS. 2*a*, 2*b* and 3*c*) and, in the retracted condition, equalizer bar 120 moves towards chord 104*a* (FIGS. 2*a*, 2*b* and 3*d*). In this way, equalizer bar 120 is repeatably moveable between positions towards and away from chord 104*a* in response to actuating slack take up device.

As mentioned above, chord 104*a* is positioned away from table 119. Hence, in the extended condition, equalizer bar 120 moves towards table 119 (FIGS. 2*a*, 2*b* and 3*c*) and, in the retracted condition, equalizer bar 120 away from table 119 (FIGS. 2*a*, 2*b* and 3*d*). In this way, equalizer bar 120 is repeatably moveable between positions towards and away from table 119 in response to actuating slack take up device.

In operation, equalizer bar 120 drives the tension of pull up cables 132*a* and 132*b* to equal each other. For example, a reference line 125 extends through slack take up device 110 and reference lines 126 and 127 extend through equalizer bar 120 along pull up cables 132*a* and 132*b*, respectively. Hence, slack take up device 110 experiences an upwardly directed force $F_1$ and pull up cables 132*a* and 132*b* experience upwardly directed forces opposed to $F_2$ and $F_3$, respectively. It should be noted that force $F_1$ is equal to the sum of forces $F_2$ and $F_3$. Force $F_1$ is applied to slack take up device 110 because slack take up device 110 is coupled with tower crown, as discussed in more detail above. Forces $F_2$ and $F_3$ are applied to pull up cables 132*a* and 132*b*, respectively, because pull up cables 132*a* and 132*b* are coupled with rotary head 106. Further, forces $F_2$ and $F_3$ are applied to equalizer bar 120 because pull up cables 132*a* and 132*b* are coupled with equalizer bar 120. In this way, the tension (i.e. forces $F_2$ and $F_3$) of pull up cables 132*a* and 132*b* is applied to slack take up device 110 through equalizer bar 120. Hence, equalizer bar 120 is coupled to rotary head 106 through a pulley system which includes pulleys 133*a*, 133*b*, 133*c* and 133*d*.

It is desirable to have reference line 125 positioned between reference lines 126 and 127. In particular, it is desirable to have reference line positioned halfway between reference lines 126 and 127. In this way, forces $F_2$ and $F_3$ are driven to equal each other, and equalizer bar 120 is driven to remain level. It is desirable to have equalizer bar 120 remain level in response to pull up cables 132*a* and 132*b* raising and lowering rotary head 106. It should be noted that equalizer bar 120 will tilt in response to forces $F_2$ and $F_3$ being unequal to each other. In this way, feed cable system 130 includes an equalizer bar which drives the tension of first and second pull up cables to equal each other in response to first and second pull up cables raising and lowering a rotary head.

Hence, equalizer bar 120 drives the difference in the tension of pull up cables 132*a* and 132*b* to zero. Further, equalizer bar 120 drives the difference in the tension (i.e. the difference between forces $F_2$ and $F_3$) of pull up cables 132*a* and 132*b* to zero in response to rotary head 106 moving along tower 102. Equalizer bar 120 drives the tension of pull up cables 132*a* and 132*b* to equal each other (i.e. forces $F_2$ and $F_3$ are drive to equal each other).

In operation, equalizer bar 120 increases and decreases the tension of pull up cable 132*a* in response to the tension of pull up cable 132*b* increasing and decreasing, respectively. Also, equalizer bar 120 increases and decreases the tension of pull up cable 132*b* in response to the tension of pull up cable 132*a* increasing and decreasing, respectively.

In operation, equalizer bar 120 drives the tension of pull up cables 132*a* and 132*b* to equal each other in response to pull up cables 132*a* and 132*b* raising and lowering rotary head 106. Further, equalizer bar 120 drives the difference in the tension of pull up cables 132*a* and 132*b* to zero. Equalizer bar 120 drives the difference in the tension of pull up cables 132*a* and 132*b* to zero in response to rotary head 106 moving along tower 102.

Rotary head 106 can be moved along tower 102 in many different ways, such as that disclosed in U.S. Patent Application No. 20030056993, wherein pulleys 133*c* and 135*a* are coupled together with a pulley support member that is moveable along tower 102. Further, pulleys 133*d* and 135*b* are coupled together with another pulley support member that is moveable along tower 102. The pulley support members can be moved along tower 102 in many different ways, such as by connecting them to a hydraulic cylinder 116 of FIG. 7*a*, or a linear motor.

Figure 4A:
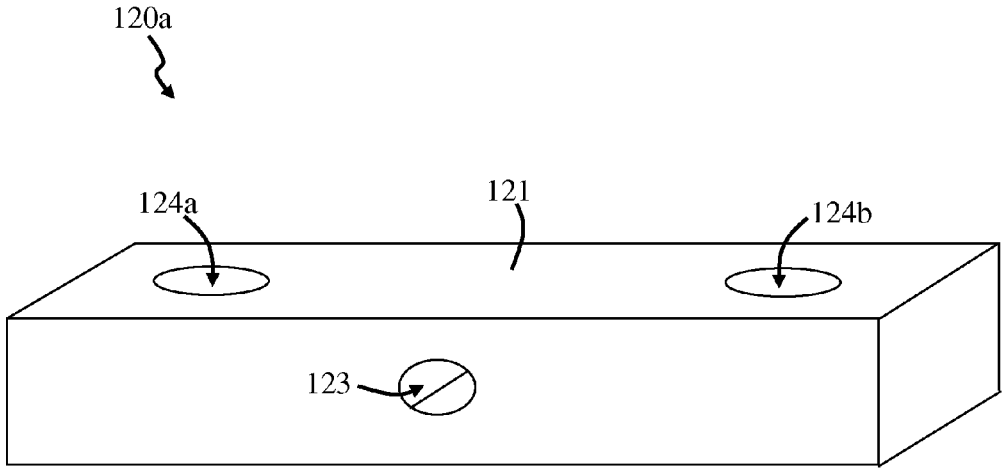
FIGS. 4*a* and 4*b* are perspective and side views, respectively, of one embodiment of an equalizer bar, in accordance with the invention, included with the feed cable system of FIGS. 2*a*, 2*b*, 2*c* and 2*d*.
Figure 4B:
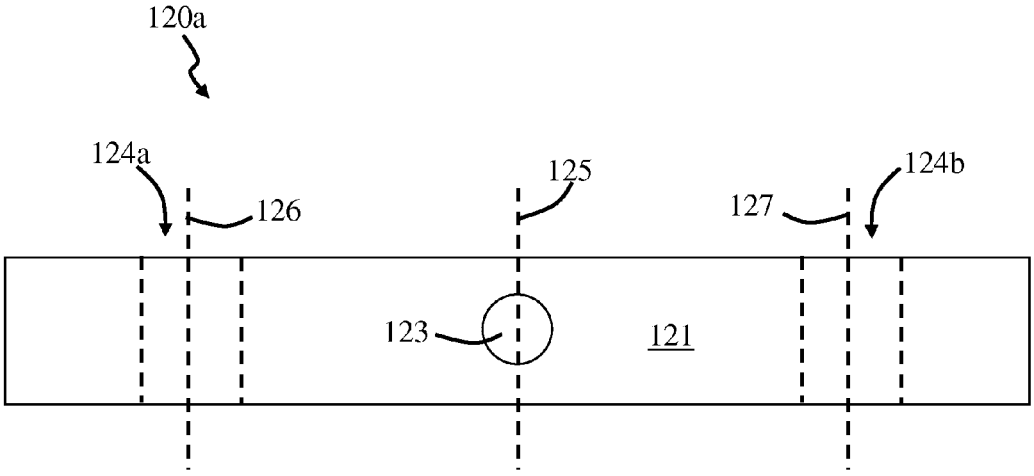

FIGS. 4*a* and 4*b* are perspective and side views, respectively, of one embodiment of an equalizer bar, denoted as equalizer bar 120*a*. In this embodiment, equalizer bar 120*a* includes an equalizer bar body 121 with openings 124*a* and 124*b* extending downwardly therethrough. Further, equalizer bar body 121 includes an opening 123 extending therethrough in a direction perpendicular to openings 124*a* and 124*b*. In this embodiment, openings 124*a* and 124*b* extend along reference lines 126 and 127, respectively, of FIG. 3, and reference line 125 extends through and perpendicular to opening 123. Hence, opening 123 is positioned between openings 124*a* and 124*b*. In one particular example, opening 123 is halfway between openings 124*a* and 124*b*.

Figure 5A:
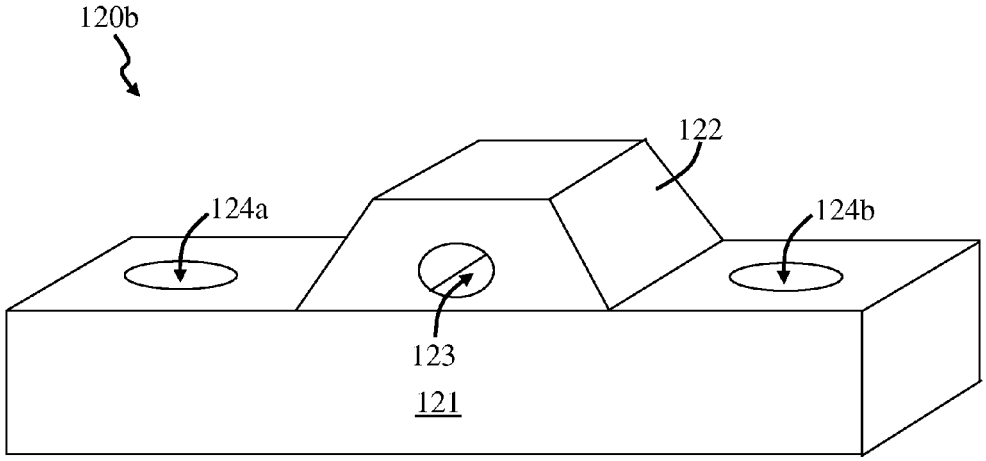
FIGS. 5*a* and 5*b* are perspective and side views, respectively, of another embodiment of an equalizer bar, in accordance with the invention, included with the feed cable system of FIGS. 2*a*, 2*b*, 2*c* and 2*d*.
Figure 5B:
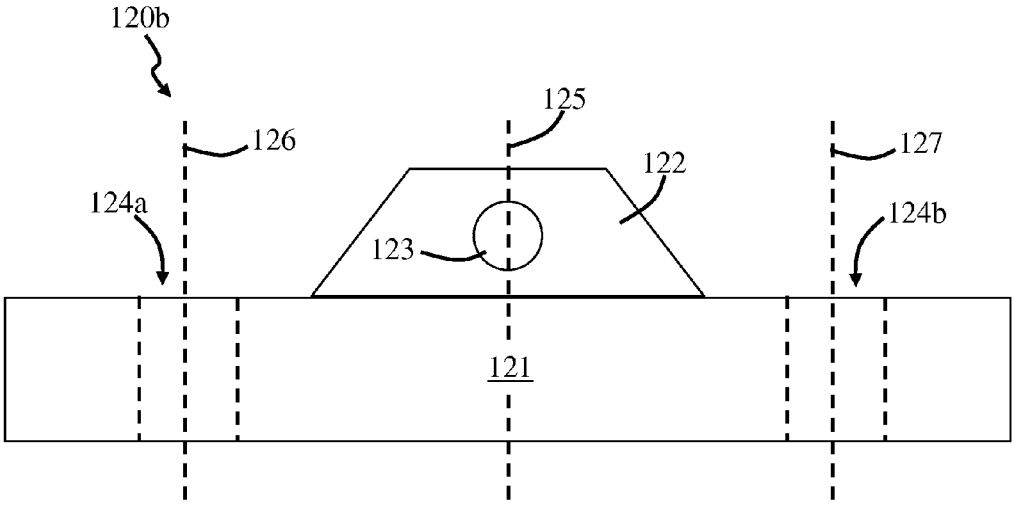

FIGS. 5*a* and 5*b* are perspective and side views, respectively, of one embodiment of an equalizer bar, denoted as equalizer bar 120*b*. In this embodiment, equalizer bar 120*b* includes equalizer bar body 121 with openings 124*a* and 124*b* extending downwardly therethrough. Further, equalizer bar body 121 includes an equalizer bar neck 122 extending upwardly from equalizer bar body 121. Opening 123 extends through equalizer bar neck 122 in a direction perpendicular to openings 124*a* and 124*b*. In this embodiment, openings 124*a* and 124*b* extend along reference lines 126 and 127, respectively, of FIG. 3, and reference line 125 extends through and perpendicular to opening 123. Hence, opening 123 is positioned between openings 124*a* and 124*b*. In one particular example, opening 123 is halfway between openings 124*a* and 124*b*.

Figure 6A:
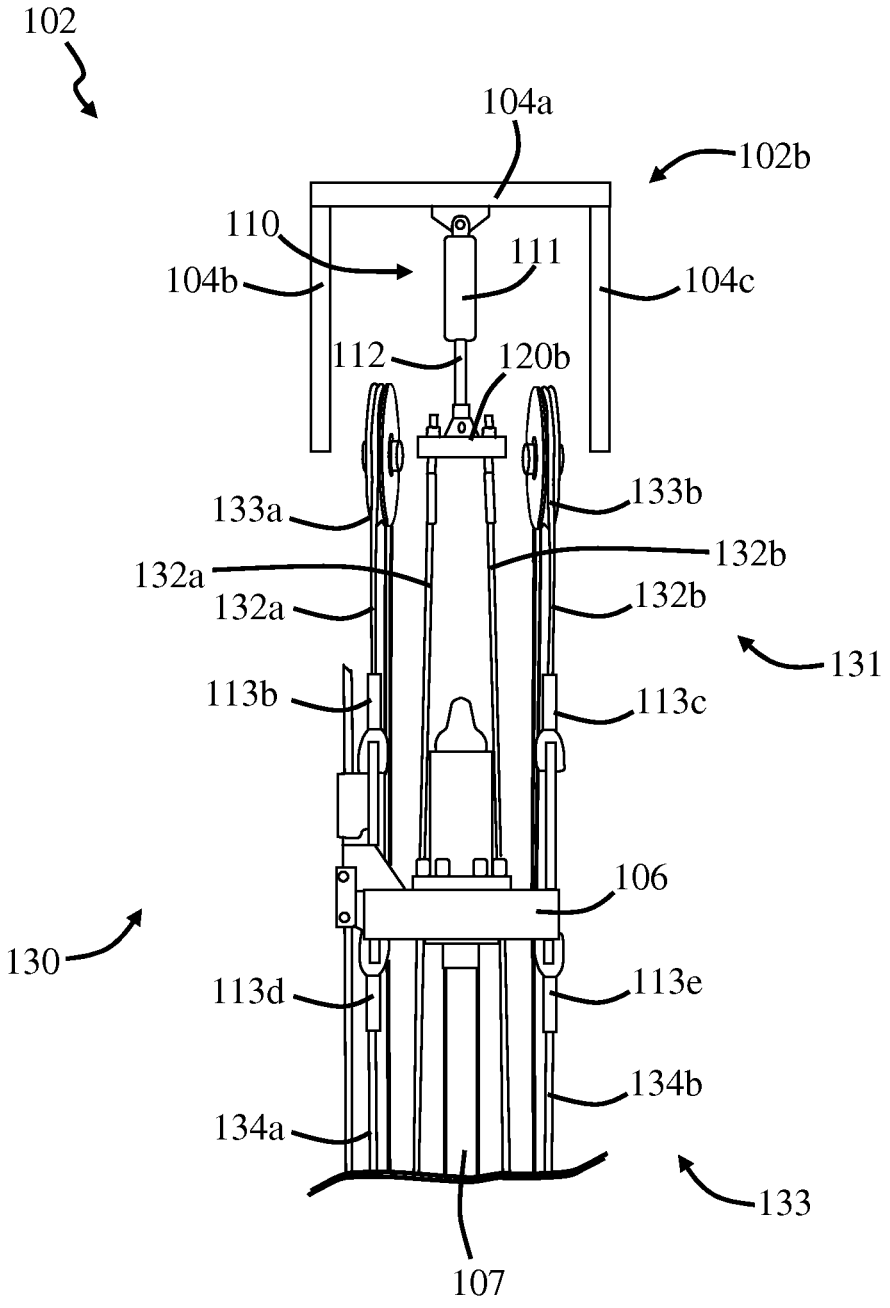
FIGS. 6*a* and 6*b* are side views of the equalizer bar of FIGS. 5*a* and 5*b* coupled with a slack take up device and pull up cables.
Figure 6B:
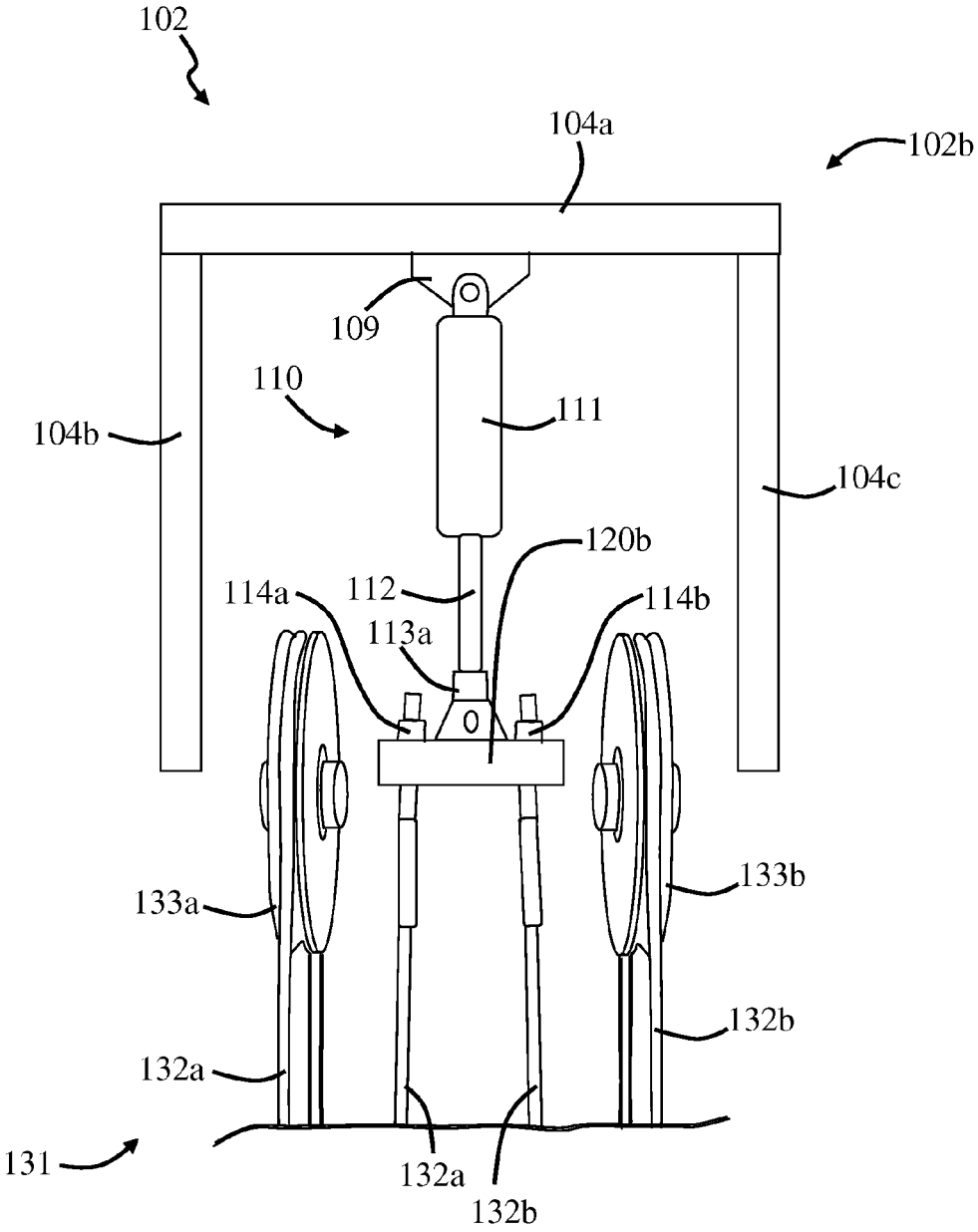

FIGS. 6*a* and 6*b* are side views of equalizer bar 120*b* coupled with slack take up device 110 and pull up cables 132*a* and 132*b*. Equalizer bar 120*b* can be coupled with pull up cables 132*a* and 132*b* in many different ways. In this embodiment, pull up cables 132*a* and 132*b* extend upwardly though openings 124*a* and 124*b* (FIGS. 5*a* and 5*b*), respectively, and are coupled with fasteners 114*a* and 114*b*, respectively. Fasteners 114*a* and 114*b* restrict the ability of pull up cables 132*a* and 132*b* to be pulled through corresponding openings 124*a* and 124*b*.

Pull up cables 132*a* and 132*b* and pull down cables 134*a* and 134*b* can be coupled with rotary head 106 in many different ways. In this embodiment, pull up cables 132*a* and 132*b* are coupled with rotary head 106 with u-joints 113*b* and 113*c*, respectively. Further, pull down cables 134*a* and 134*b* are coupled with rotary head 106 with u-joints 113*d* and 113*e*.

Slack take up device 110 can be coupled with equalizer bar 120 in many different ways. In this embodiment, slack take up device 110 includes a u-joint 113*a* coupled with piston 112, wherein u-joint 113*a* is coupled to equalizer bar 120 by a pin which extends through opening 123 and u-joint 113*a*. The pin restricts the ability of u-joint 113*a* to move away from equalizer bar body 121.

Figure 7A:
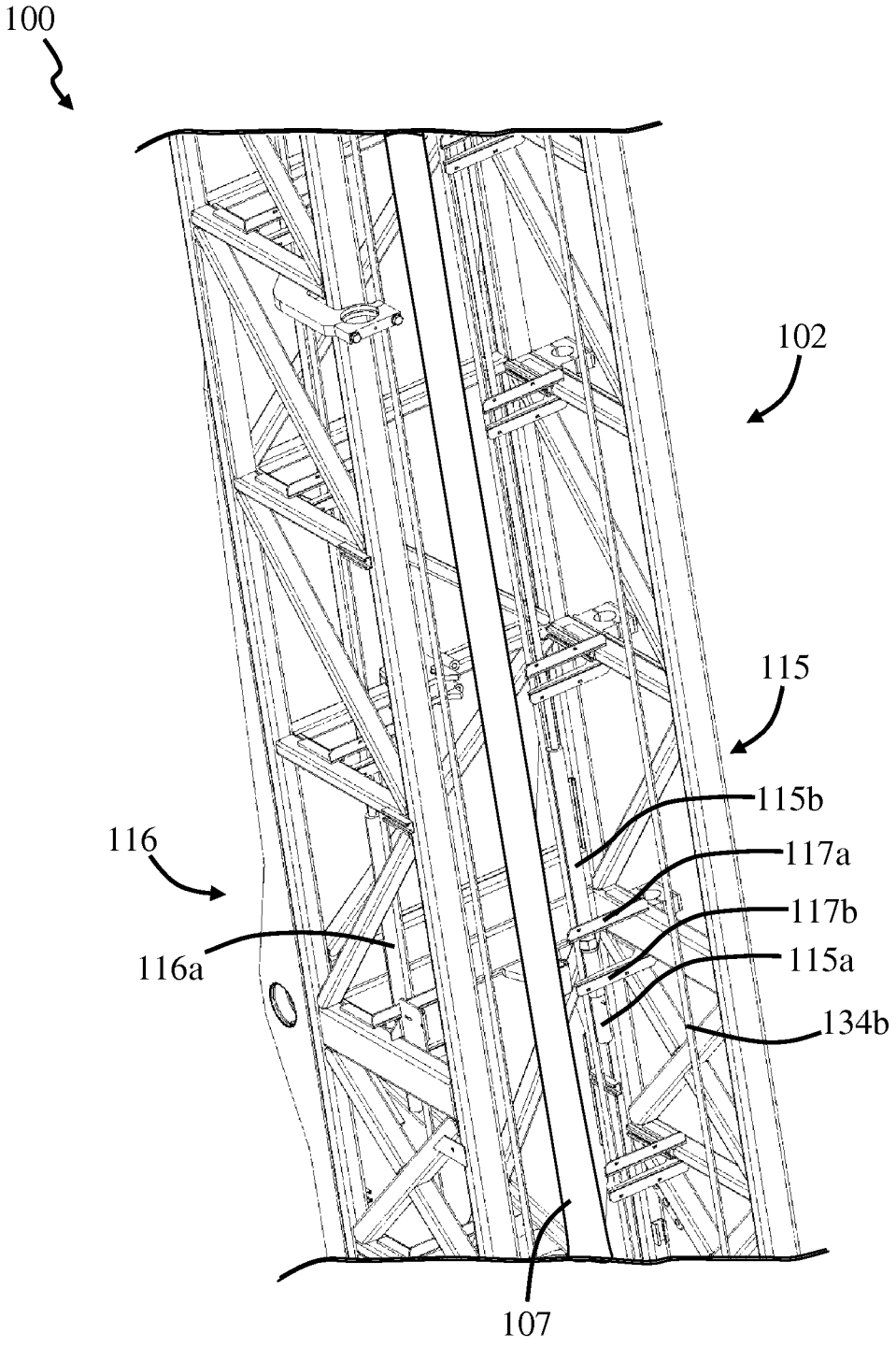
FIG. 7*a* is a perspective view of the tower of FIG. 1 and tension adjusting devices included with the feed cable system of FIGS. 2*a*, 2*b*, 2*c* and 2*d*.
Figure 7B:
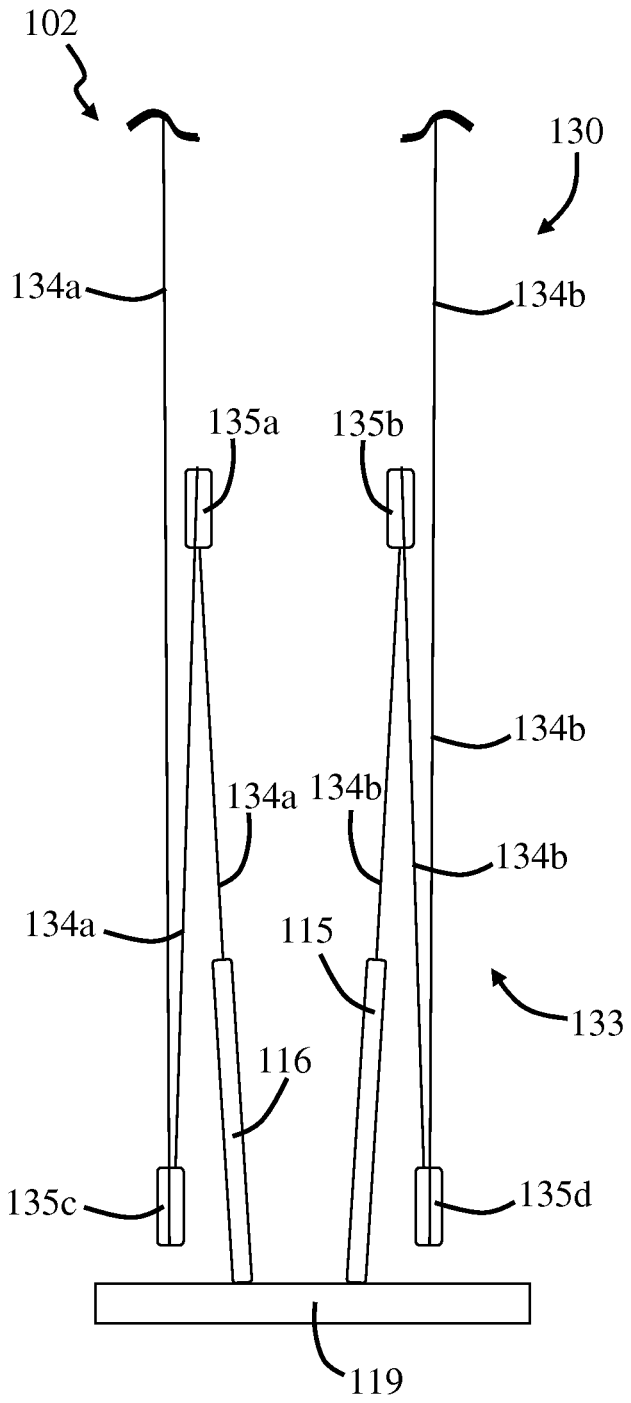
FIG. 7*b* is a side view of the tension adjusting devices of FIG. 7*a* included with the feed cable system of FIGS. 2*a*, 2*b*, 2*c* and 2*d*.
Figure 7C:
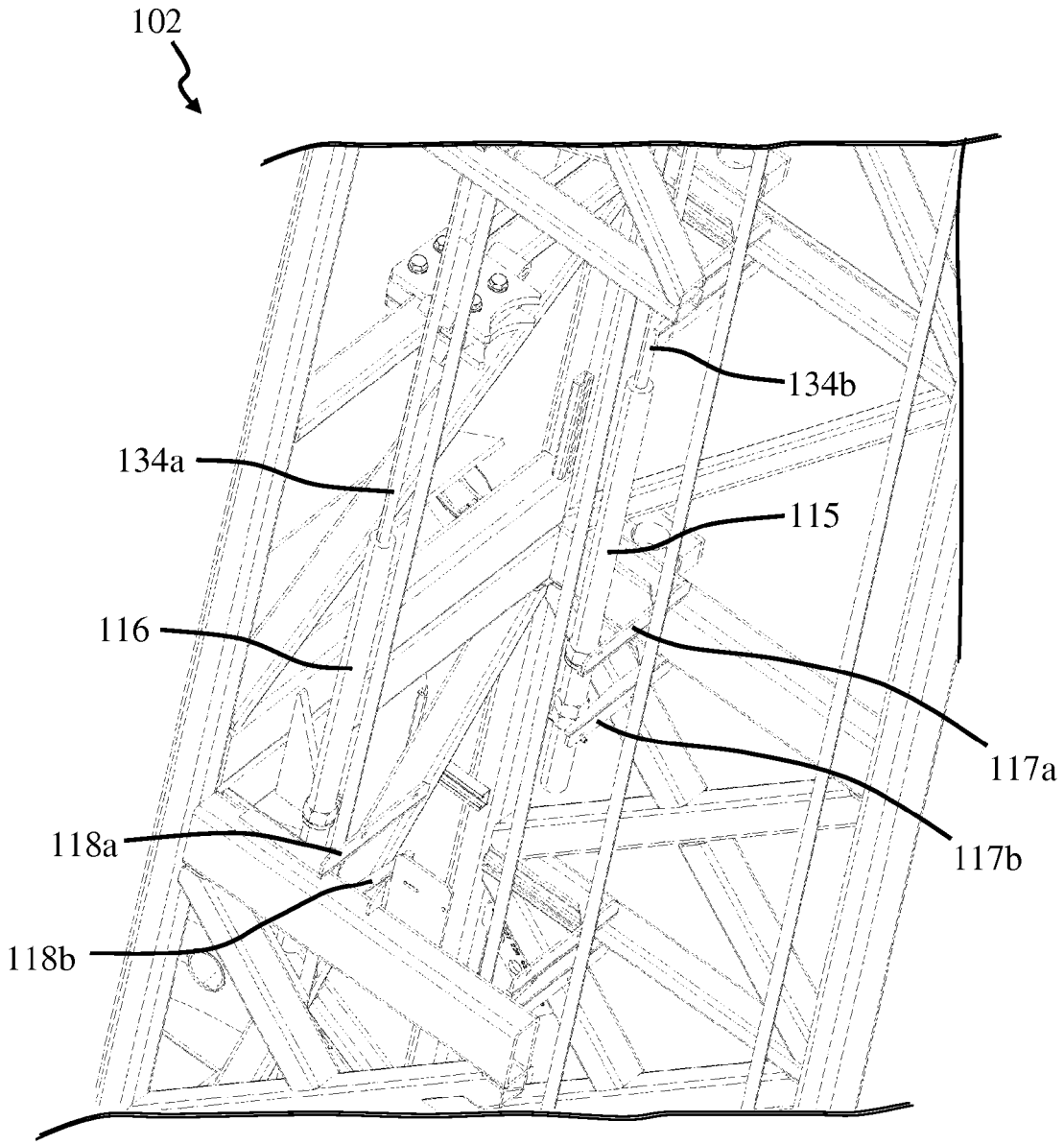
FIG. 7*c* is a close-up perspective view of the tension adjusting devices of FIGS. 7*a* and 7*b* carried by the tower.
Figure 7D:
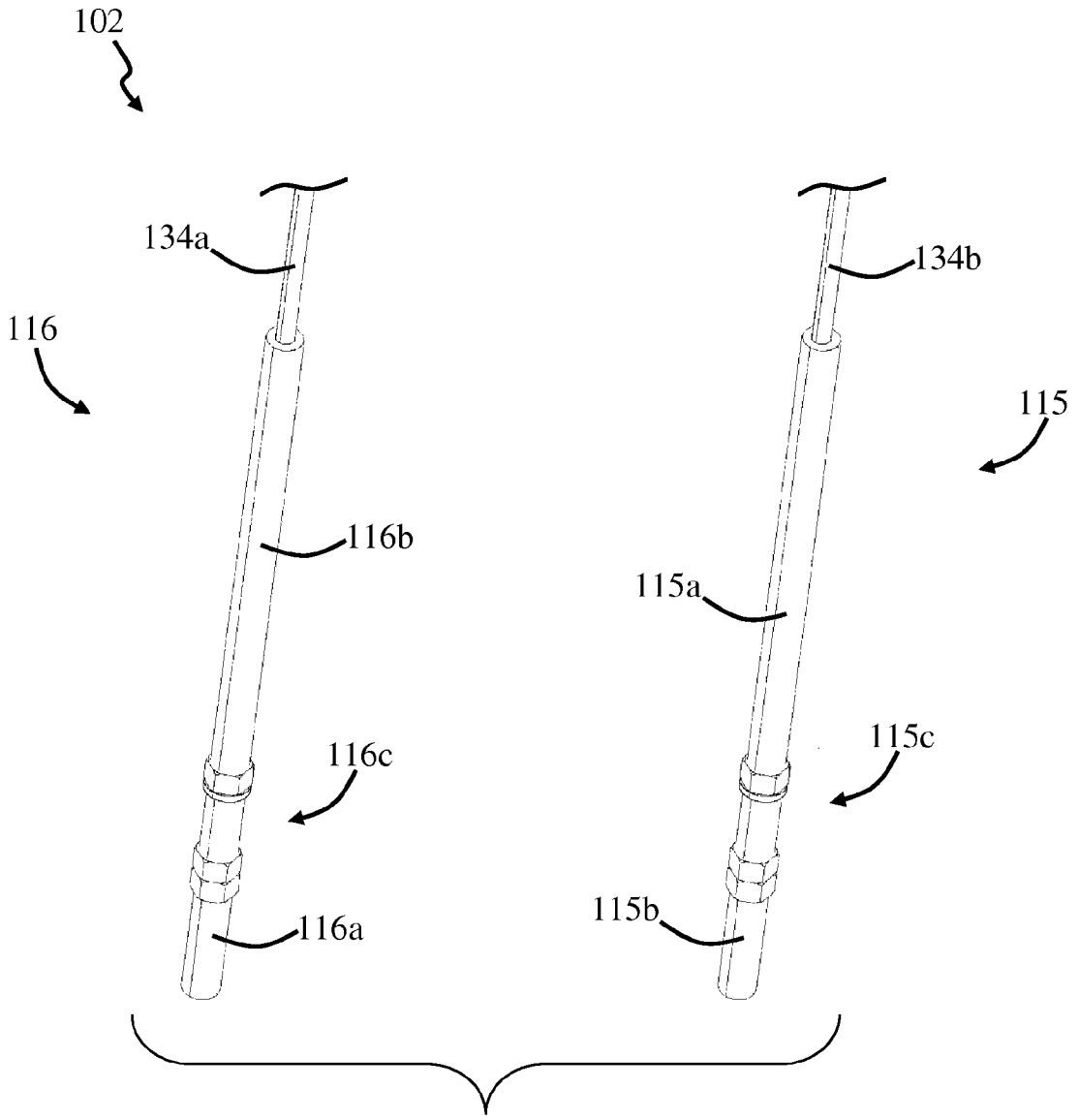
FIG. 7*d* is a perspective view of the tension adjusting devices of FIGS. 7*a* and 7*b*.

FIGS. 7*a* and 7*b* are perspective and side views, respectively, of a portion of tower 102 proximate to tower base 102*a* and table 119. In this embodiment, drilling machine 100 includes a tension adjusting device for adjusting the tension of a pull down cable.

In this particular embodiment, drilling machine 100 includes tension adjusting devices 115 and 116, wherein tension adjusting device 115 is operatively coupled with pull down cable 134*b* and tension adjusting device 116 is operatively coupled with pull down cable 134*a*, as shown in FIG. 7*b*.

Tension adjusting devices 115 and 116 can be embodied in many different ways. In this embodiment, tension adjusting device 115 includes a threaded rod 115*a* which is received through an opening of an outer threaded sleeve 115*b*, wherein threaded rod 115*a* is coupled with pull down cable 134*b* and outer threaded sleeve 115*b* is coupled with table 119. It should be noted that outer threaded sleeve 115*b* can be coupled directly to table 119, or it can be coupled indirectly to table 119 through another structure. For example, in this embodiment, outer threaded sleeve 115*b* is coupled with tower 102 through brackets 117*a* and 117*b*, and tower 102 is coupled with table 119. In general, however, the movement of outer threaded sleeve 115*b* upwardly from table 119 is restricted. Hence, the movement of outer threaded sleeve 115*b* upwardly from table 119 in response to an upwardly directed force applied to outer threaded sleeve 115*b* is restricted. The upwardly extending fore can be applied to outer threaded sleeve 115*b* in many different ways, such as by the force applied to pull down cable 134*b* in response to the weight or rotary head 106. This force is applied to outer threaded sleeve 115*b* because pull down cable 134*b* is coupled with outer threaded sleeve 115*b* through threaded rod 115*a*.

In this embodiment, tension adjusting device 116 includes a threaded rod 116*a* which is received through an opening of an outer threaded sleeve 116*b*, wherein threaded rod 116*a* is coupled with pull down cable 134*a* and outer threaded sleeve 116*b* is coupled with table 119. It should be noted that outer threaded sleeve 116*b* can be coupled directly to table 119, or it can be coupled indirectly to table 119 through another structure. For example, in this embodiment, outer threaded sleeve 116*b* is coupled with tower 102 through brackets 118*a* and 118*b*, and tower 102 is coupled with table 119. In general, however, the movement of outer threaded sleeve 116*b* upwardly from table 119 is restricted. Hence, the movement of outer threaded sleeve 116*b* upwardly from table 119 in response to an upwardly directed force applied to outer threaded sleeve 116*b* is restricted. The upwardly extending fore can be applied to outer threaded sleeve 116*b* in many different ways, such as by the force applied to pull down cable 134*a* in response to the weight or rotary head 106. This force is applied to outer threaded sleeve 116*b* because pull down cable 134*a* is coupled with outer threaded sleeve 116*b* through threaded rod 116*a*.

In operation, the tension of pull down cable 134*b* is adjusted in response to rotating threaded rod 115*a* relative to outer threaded sleeve 115*b*. Threaded rod 115*a* can be rotated relative to outer threaded sleeve 115*b* in many different ways. In this embodiment, tension adjusting device 115 includes an adjustment collar 115*c* which allows threaded rod 115*a* to be moved relative to outer threaded sleeve 115*b* in a controlled manner. Adjustment collar 115*c* can be embodied in many different ways. In this embodiment, adjustment collar 115*c* is embodied as a threaded nut which is threadingly engaged with threaded rod 115*a*. Adjustment collar 115*c* is rotated about threaded rod 115*a* to move threaded rod 115*a* relative to threaded sleeve 115*b*.

In one particular situation, the tension of pull down cable 134*b* is increased in response to rotating threaded rod 115*a* in a direction relative to outer threaded sleeve 115*b*, and the tension of pull down cable 134*b* is decreased in response to rotating threaded rod 115*a* in an opposed direction relative to outer threaded sleeve 115*b*. The direction and opposed direction are typically clockwise and counter clockwise, respectively. However, in some situations, the direction and opposed direction are counter clockwise and clockwise, respectively. It should be noted that threaded rod 115*a* moves towards table 119 in response to rotating threaded rod 115*a* in the direction. Further, threaded rod 115*a* moves away from table 119 in response to rotating threaded rod 115*a* in the opposed direction.

In operation, the tension of pull down cable 134*a* is adjusted in response to rotating threaded rod 116*a* relative to outer threaded sleeve 116*b*. Threaded rod 116*a* can be rotated relative to outer threaded sleeve 116*b* in many different ways. In this embodiment, tension adjusting device 116 includes an adjustment collar 116*c* which allows threaded rod 116 to be moved relative to outer threaded sleeve 116 in a controlled manner. Adjustment collar 116*c* can be embodied in many different ways. In this embodiment, adjustment collar 116*c* is embodied as a threaded nut which is threadingly engaged with threaded rod 116*a*. Adjustment collar 116*c* is rotated about threaded rod 116*a* to move threaded rod 116*a* relative to threaded sleeve 116*b*.

In one particular situation, the tension of pull down cable 134*a* is increased in response to rotating threaded rod 116*a* in a direction relative to outer threaded sleeve 116*b*, and the tension of pull down cable 134*a* is decreased in response to rotating threaded rod 116*a* in an opposed direction relative to outer threaded sleeve 116*b*. The direction and opposed direction are typically clockwise and counter clockwise, respectively. However, in some situations, the direction and opposed direction are counter clockwise and clockwise, respectively. It should be noted that threaded rod 116*a* moves towards table 119 in response to rotating threaded rod 116*a* in the direction. Further, threaded rod 116*a* moves away from table 119 in response to rotating threaded rod 116*a* in the opposed direction.

One advantage of tension adjusting devices 115 and 116 is that devices 115 and 116 are capable of controlling the tension of the pull down cables with a greater accuracy. Tension adjusting devices 115 is capable of controlling the tension of the pull down cables with a greater accuracy because of the threads of threaded rod 115*a* and outer threaded sleeve 115*b*. Tension adjusting devices 116 is capable of controlling the tension of the pull down cables with a greater accuracy because of the threads of threaded rod 116*a* and outer threaded sleeve 116*b*. In general, as the number of threads of the threaded rod and outer threaded sleeve increases, the tension of the pull down cables can be controlled with greater accuracy. Further, as the number of threads of the threaded rod and outer threaded sleeve decreases, the tension of the pull down cables can be controlled with less accuracy. Hence, the number of threads of the threaded rods and threaded sleeves are chosen to provide a desired control of the tension of the pull down cables.

The embodiments of the invention described herein are exemplary and numerous modifications, variations and rearrangements can be readily envisioned to achieve substantially equivalent results, all of which are intended to be embraced within the spirit and scope of the invention.

The invention claimed is:

1. A drilling machine, comprising:

a tower carried by a platform;

a rotary head;

a feed cable system which operatively couples the rotary head to the tower, wherein the feed cable system includes first and second pull up cables and an equalizer bar, wherein the equalizer bar is coupled to the first and second pull up cables; and a slack take up device which couples the equalizer bar to the tower, wherein the slack take up device includes a piston and cylinder.

2. The machine of claim 1, wherein the slack take up device includes an actuator.

3. The machine of claim 1, wherein the slack take up device is repeatably moveable between extended and retracted conditions.

4. The machine of claim 1, further including a slack take up device which couples the first and second pull up cables to a tower crown of the tower through the equalizer bar.

5. The machine of claim 1, wherein the equalizer bar is positioned proximate to a tower crown of the tower.

6. The machine of claim 5, wherein the equalizer bar drives the tension of the first and second pull up cables to equal each other in response to the first and second pull up cables raising and lowering the rotary head.

7. The machine of claim 5, wherein the equalizer bar drives the difference of the tension of the first and second pull up cables to zero.

8. The machine of claim 5, wherein the equalizer bar drives the difference of the tension of the first and second pull up cables to zero in response to the rotary head moving along the tower.

9. The machine of claim 1, wherein the slack take up device is coupled to a chord of the tower.

10. The machine of claim 1, further including first and second pull down cables coupled to the rotary head.

11. The machine of claim 10, further including a first tension adjusting device coupled to the first pull down cable and a table of the drilling machine.

12. The machine of claim 11, further including a second tension adjusting device coupled to the second pull down cable and the table.

13. A feed cable system which operatively couples a rotary head with a tower, the feed cable system comprising:

first and second pull up cables coupled to the rotary head;

an equalizer bar coupled to the first and second pull up cables;

a slack take up device which couples the first and second pull up cables to a tower crown of the tower through the equalizer bar;

first and second pull down cables coupled to the rotary head, a first tension adjusting device coupled to the first pull down cable and a table of the drilling machine; and a second tension adjusting device coupled to the second pull down cable and the table.

14. The system of claim 13, wherein the tension of the first and second pull up cables is applied to the slack take up device through the equalizer bar.

15. The system of claim 13, wherein the equalizer bar drives the tension of the first and second pull up cables to equal each other.

16. The system of claim 13, wherein the equalizer bar drives the difference in the tension of the first and second pull up cables to zero.

17. The system of claim 13, wherein the equalizer bar increases and decreases the tension of the first pull up cable in response to the tension of the second pull up cable increasing and decreasing, respectively.

18. The system of claim 13, wherein the equalizer bar is coupled to the rotary head through a pulley system.

19. A feed cable system, comprising:

an equalizer bar;

first and second pull up cables coupled together with the equalizer bar; and a slack take up device coupled with the first and second pull up cables through the equalizer bar, wherein the slack take up device is repeatably moveable between extended and retracted conditions and wherein the slack take up device included a piston and cylinder.

20. The system of claim 19, wherein the slack take up device operates as an actuator.

21. The system of claim 19, wherein the slack take up device is repeatably moveable between extended and retracted conditions.

22. The system of claim 19, wherein the equalizer bar includes an equalizer bar body with first and second equalizer bar vertical openings extending therethrough.

23. The system of claim 22, wherein the equalizer bar body includes an equalizer bar horizontal opening extending therethrough.

24. The system of claim 19, wherein the equalizer bar includes an equalizer bar neck with an equalizer bar horizontal opening extending therethrough.

* * * * *